US007914013B2

(12) United States Patent
Karlsen

(10) Patent No.: US 7,914,013 B2
(45) Date of Patent: Mar. 29, 2011

(54) SNOWBOARD FOR RAILS

(75) Inventor: Jørgen Karlsen, Høvik (NO)

(73) Assignee: Hiturn AS, Raufoss (NO)

( * ) Notice: Subject to any disclaimer, the term of this patent is extended or adjusted under 35 U.S.C. 154(b) by 158 days.

(21) Appl. No.: 11/795,109

(22) PCT Filed: Jan. 12, 2006

(86) PCT No.: PCT/NO2006/000014

§ 371 (c)(1),
(2), (4) Date: Jan. 10, 2008

(87) PCT Pub. No.: WO2006/075919

PCT Pub. Date: Jul. 20, 2006

(65) Prior Publication Data

US 2009/0121453 A1 May 14, 2009

(30) Foreign Application Priority Data

Jan. 13, 2005 (NO) ..... 20050221

(51) Int. Cl.
*A63C 5/048* (2006.01)

(52) U.S. Cl. ..... 280/14.22; 280/609

(58) Field of Classification Search ..... 280/14.22, 280/608, 609; 441/68
See application file for complete search history.

(56) References Cited

U.S. PATENT DOCUMENTS 3,134,992 A * 6/1964 Tyll ..... 441/70
4,433,855 A * 2/1984 Wyke ..... 280/609
4,795,184 A * 1/1989 Diard et al. ..... 280/609
4,838,572 A * 6/1989 Diard et al. ..... 280/609
4,971,349 A * 11/1990 Diard et al. ..... 280/609
4,974,868 A * 12/1990 Morris ..... 280/609
5,018,760 A * 5/1991 Remondet ..... 280/609
5,108,124 A * 4/1992 Pascal et al. ..... 280/609
5,135,249 A * 8/1992 Morris ..... 280/609
5,242,187 A * 9/1993 Diard et al. ..... 280/609
5,303,949 A * 4/1994 Harper et al. ..... 280/608
5,462,304 A * 10/1995 Nyman ..... 280/609
5,511,815 A * 4/1996 Karlsen ..... 280/609
5,580,078 A 12/1996 Vance
5,876,056 A * 3/1999 Karlsen ..... 280/609
6,062,585 A * 5/2000 Hess ..... 280/608
6,663,137 B2 * 12/2003 Karlsen ..... 280/609
7,073,810 B2 * 7/2006 Wilson ..... 280/609
7,219,916 B2 * 5/2007 Olson ..... 280/609

(Continued)

FOREIGN PATENT DOCUMENTS

DE 29 24 023 A1 12/1980

(Continued)

*Primary Examiner* — Jeffrey J Restifo
(74) *Attorney, Agent, or Firm* — Merchant & Gould P.C.

(57) ABSTRACT

A snowboard for use on rails and installations found in snowboard parks is disclosed. The snowboard has a combination of features specially adapted for rails, and other known per se features from boards with three running surfaces, selected and employed on snowboards so as to achieve greater stability on rails, with a substantially reduced risk of catching the steel edge in irregularities, while retaining many of the good running characteristics of boards with 3 running surfaces. Some of the features of the snowboard are that more than 70% of the snowboard's base is composed of a flat central portion, and that there are secondary running surfaces from the steel edges and inwards, either along the entire length of the board or at any rate in the front and rear portions of the snowboard.

14 Claims, 4 Drawing Sheets

U.S. PATENT DOCUMENTS

| | | | | |
|---|---|---|---|---|
| 7,311,165 | B2 * | 12/2007 | Roberts et al. | 180/182 |
| 2002/0195780 | A1 | 12/2002 | Karlsen | |
| 2004/0262884 | A1 * | 12/2004 | Langford et al. | 280/601 |
| 2007/0001427 | A1 * | 1/2007 | Gogarty | 280/609 |
| 2008/0272576 | A1 * | 11/2008 | Karlsen | 280/609 |
| 2009/0008906 | A1 * | 1/2009 | Karlsen | 280/609 |
| 2009/0121453 | A1 * | 5/2009 | Karlsen | 280/608 |

FOREIGN PATENT DOCUMENTS

| | | | |
|---|---|---|---|
| DE | 20 2004 007 082 | U1 | 10/2004 |
| EP | 1 338 312 | A1 | 8/2003 |
| FR | 2 575 928 | | 7/1986 |
| WO | WO 95/13119 | | 5/1995 |
| WO | WO 95/21662 | | 8/1995 |

* cited by examiner

3
A
A
2
1
2
A
A
2
1
5
2
3
2
2
5
B
B
2
1
2
B
B
2
1
5
2
2
C
C
C
C
2
1
5
2
5
4
4

3
A
A
2
1
2
1
1
1
B
B
C
C
2
1
2
4
2
2
5
1
5
1
2
2
5
1
3
5
5
4

SNOWBOARD FOR RAILS

TECHNICAL FIELD

The invention relates to a snowboard consisting of a board on which two bindings are mounted on the surface of the board, at a distance apart approximately corresponding to ⅓ of the board's length. The board is designed with inwardly curved edge portions, the board having a greater width at both ends at the transition to the tips. The board has upwardly curved tips, possibly with a more moderate tip at one end.

BACKGROUND

Snowboards today are normally designed with a flat base surface between the tips at the two ends. For steering the board is edged and the weight is distributed between the feet in the two bindings.

From Norwegian patent application no. 981056 a snowboard is known which has a base completely or partly divided into three running surfaces. The object of this patent, however, is to give optimum dynamic when riding the boards on snow. A minimum width is therefore indicated on the sloping lateral surfaces.

The present invention is based on testing of snowboards with bases according to the described patent, when the surprising discovery was made that the first base surface of the regulation bases was too narrow to be optimal for rails. It was found that there was a substantial potential for improvement for use on rails if the flat middle base surface is made much wider, with the result that the secondary running surfaces become correspondingly narrow. The advantage is that the wide central portion is wide enough to form a stable base both for sideways and parallel sliding on rails. At the same time the upwardly sloping secondary base surfaces will prevent the steel edges from catching in small irregularities on the rail that cause the rider to land on his head on the ground.

For use on rails the flat central portion of the base should be as wide as possible, in order to achieve maximum stability, while the secondary base surfaces must be wide enough for the steel edge to be raised slightly over the rail, thereby preventing it from becoming caught.

A good deal of testing has shown that the optimal width for the secondary base surfaces is 2-3 cm, but very good results are also obtained within the interval 1-4 cm, and right at the ends at the transition to the tips where the board is widest, some shorter portions wider than 4 cm may even be contemplated. By means of this design a board is obtained which is both ideal for rails, while at the same time retaining most of the dynamic characteristics of tripartite bases for riding on snow.

However, no snowboard is used only on rails, since after all most of the running takes place on snow. This board therefore has secondary running surfaces which twist up from the middle towards the tip/the rear tip. Over its entire length, or over substantial parts of its length, the board has running surfaces called secondary lateral areas (2) on both sides of the central flat running surface (1) called the first base surface.

On this basis, therefore, it is the object of the invention to provide an improved snowboard specially adapted to achieve increased safety on rails. This is achieved by a snowboard which is characterised by the features which will become apparent from the patent claims.

The invention solves this special problem for snowboards by means of the special design of a raised lateral area from the following criteria:

1. The secondary lateral area (2) must have a certain minimum width which is large enough for the steel edge to be raised far enough above the rail to avoid becoming caught in irregularities.

2. The first base surface (1) must be as wide as possible when sliding with the board along the rail in order to avoid skidding due to running on a sloping lateral area, and when sliding sideways a wider central portion will give greater stability.
3. The cross section shows the base as three substantially straight lines in those parts of the board where there are secondary lateral areas, and the angle formed by the secondary lateral areas with the first base surface is substantially increasing from the middle towards the front and rear tips.

SUMMARY

A snowboard consisting of a board on which two bindings are mounted on the surface of the board, at a distance apart approximately corresponding to ⅓ of the board's length. The board is designed with inwardly curved edge portions and has upwardly curved tips (3), possibly with a more moderate tip at one end. According to the invention a board of this kind for use on rails and installations found in snowboard parks is provided with a combination of features specially adapted for rails, and other known per se features from boards with three running surfaces, selected and employed on snowboards so as to achieve greater stability on rails, with a substantially reduced risk of catching the steel edge in irregularities, while retaining many of the good running characteristics of boards with 3 running surfaces, these features being: a) that more than 70% of the snowboard's base is composed of a flat central portion—the first base surface (1) along the entire length of the board between (A-A) and (C-C), b) that there are secondary running surfaces (2) from the steel edges and inwards, either along the entire length of the board or at any rate in the front and rear portions of the snowboard, i.e. from lines (A-A) and (C-C) and inwards towards the middle, c) that in an arbitrary cross section where there are secondary running surfaces (2), these will substantially extend 1-4 cm inwards from the steel edges, preferably 2-3 cm inwards, before the angle of the running surface changes, and continue in the flat central portion (1). Only a shorter portion nearest lines (A-A) and (C-C) can have secondary running surfaces that are wider than 4 cm, d) that the secondary lateral areas (2) in cross section will form substantially straight lines, e) that the secondary areas are rigid and not in contact with the ground if the board is not being edged, f)-t-hat-the-angle which the secondary lateral areas forms—with the, first base surface, viewed in cross section, will substantially be increasing when moving from the transversal lines where the secondary lateral areas begin, or in (B-B) towards the transition to the tips (A-A or C-C), where the angle is always greater than 1 degree, and preferably greater than 2 degrees, particularly greater than 3 degrees, and g) that the secondary lateral areas (2) substantially twist up from the plane of the first base surface (1) as the distance to the board's central transversal axis (B-B) increases.

DETAILED DESCRIPTION

Figure 1:
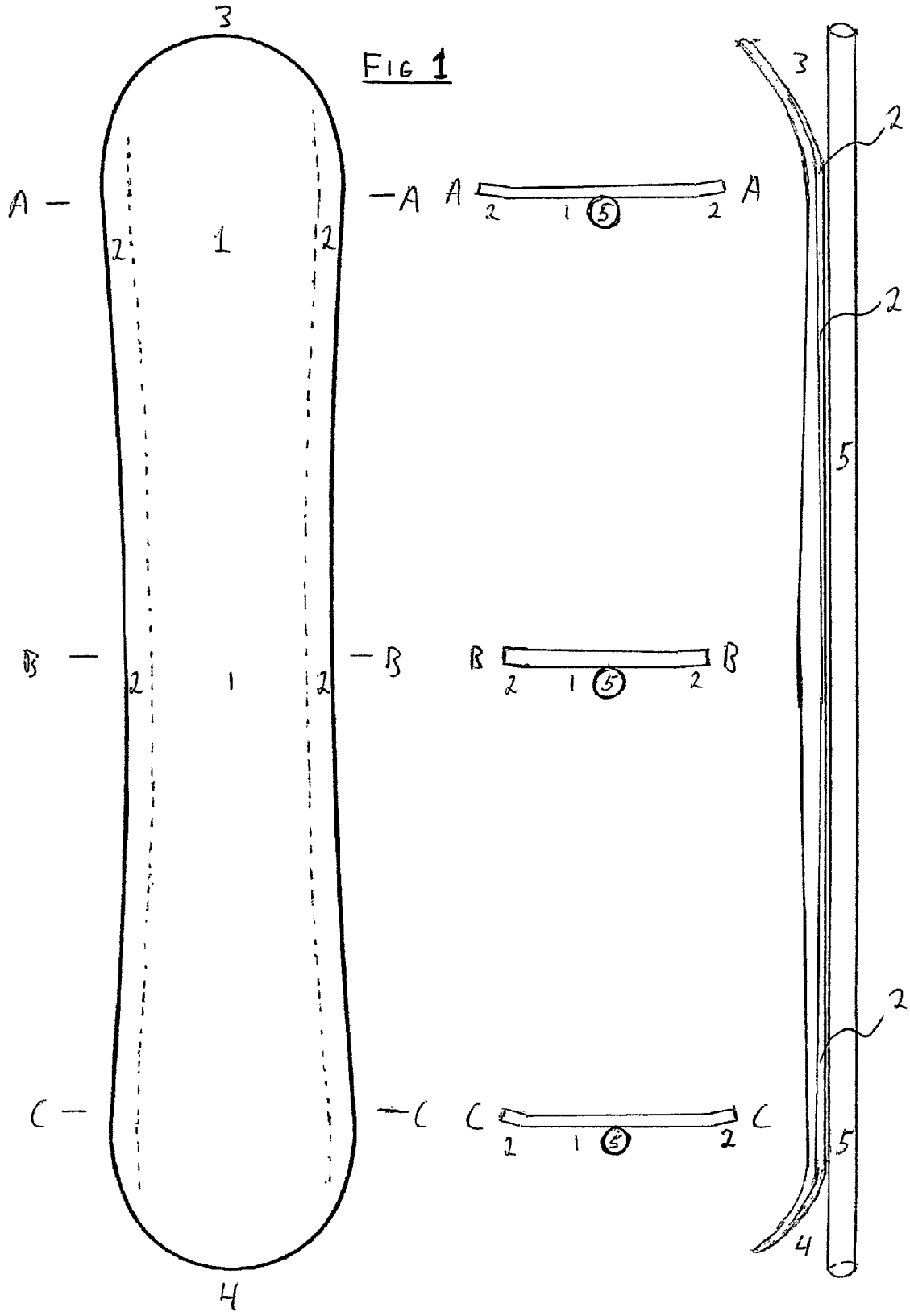
FIG. 1 shows top, side and cross-sectional views of a first embodiment of a snowboard to the disclosure.

The invention will now be illustrated in greater detail by means of the embodiments which are depicted in the drawings, where the cross sections either show the boards along or across tubes, which are a common type of rail. In both these positions it is easy to understand that a wider first base surface gives greater stability, while it is only when riding across the rail that any positive safety effect is obtained by the raised steel edges, which are raised on account of the secondary lateral areas (2).

FIG. 1 illustrates a snowboard viewed from above according to the invention, where the transition under the board between the first base surface 1 and the secondary lateral areas 2 is depicted by a dot-and-dash line. At the side are illustrated the associated cross sections with the board located along a tube. On the right the board is shown viewed from the side, still on a tube, and pressed down against the tube as the board is when in use. There are secondary lateral areas 2 along the whole of the first base surface 1, and the secondary lateral areas have a constant width. The cross sections show the board along the rail.

Figure 2:
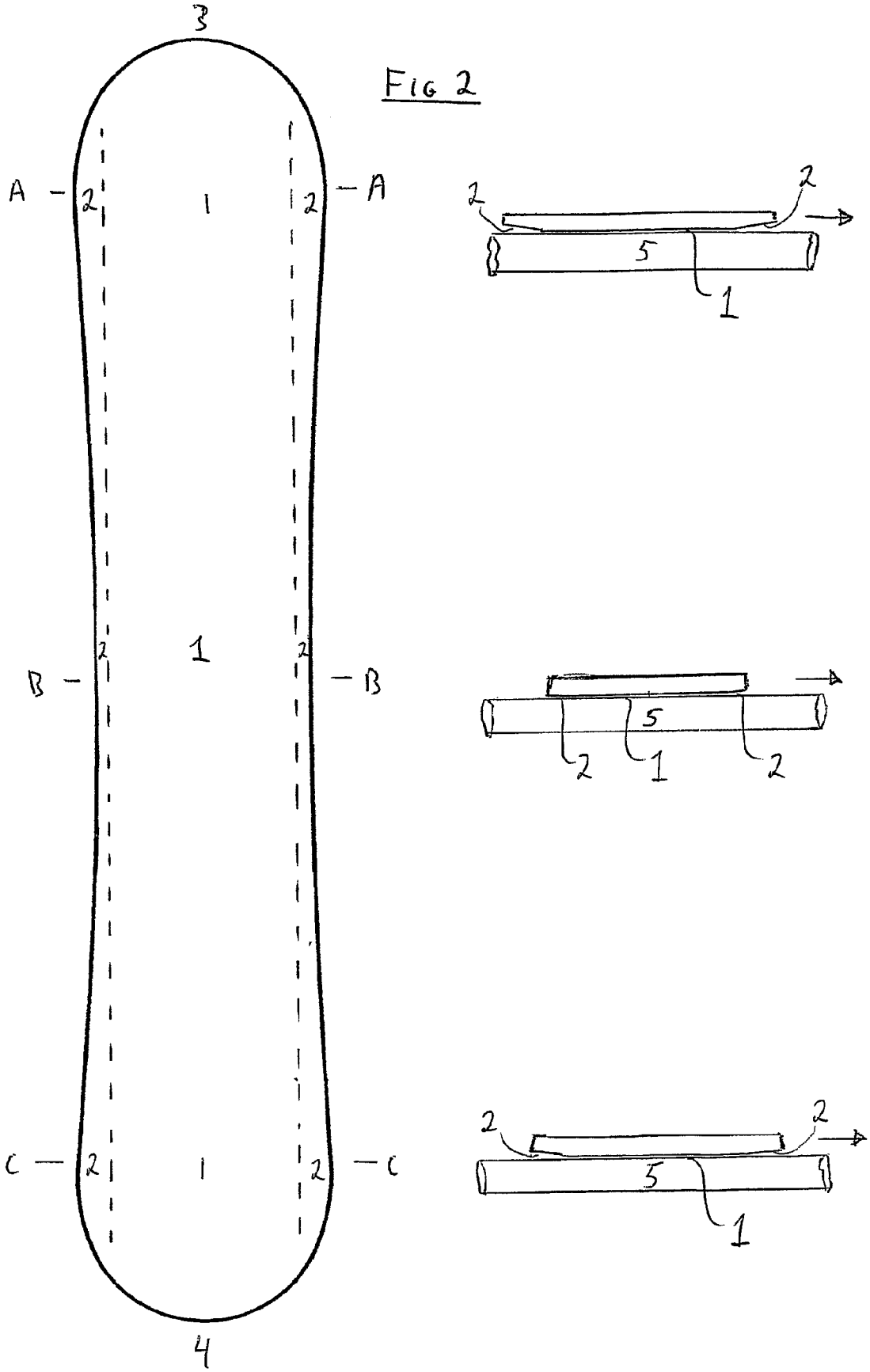
FIG. 2 shows top and cross-sectional views of a second embodiment of a snowboard to the disclosure.

FIG. 2 illustrates a snowboard where there are secondary lateral areas 2 along the whole of the first base surface 1, and where the first base surface has a reasonably constant width. The cross sections depict the board across the rail. There is normally only one rail, so when a rail is illustrated here under both the front, central and rear portions, this is to show different ways of positioning oneself on the rail. The arrow shows the direction of travel. Viewed from the side the board will closely resemble the board in FIG. 1 if it is pressed flat against the ground (the spring is removed).

Figure 3:
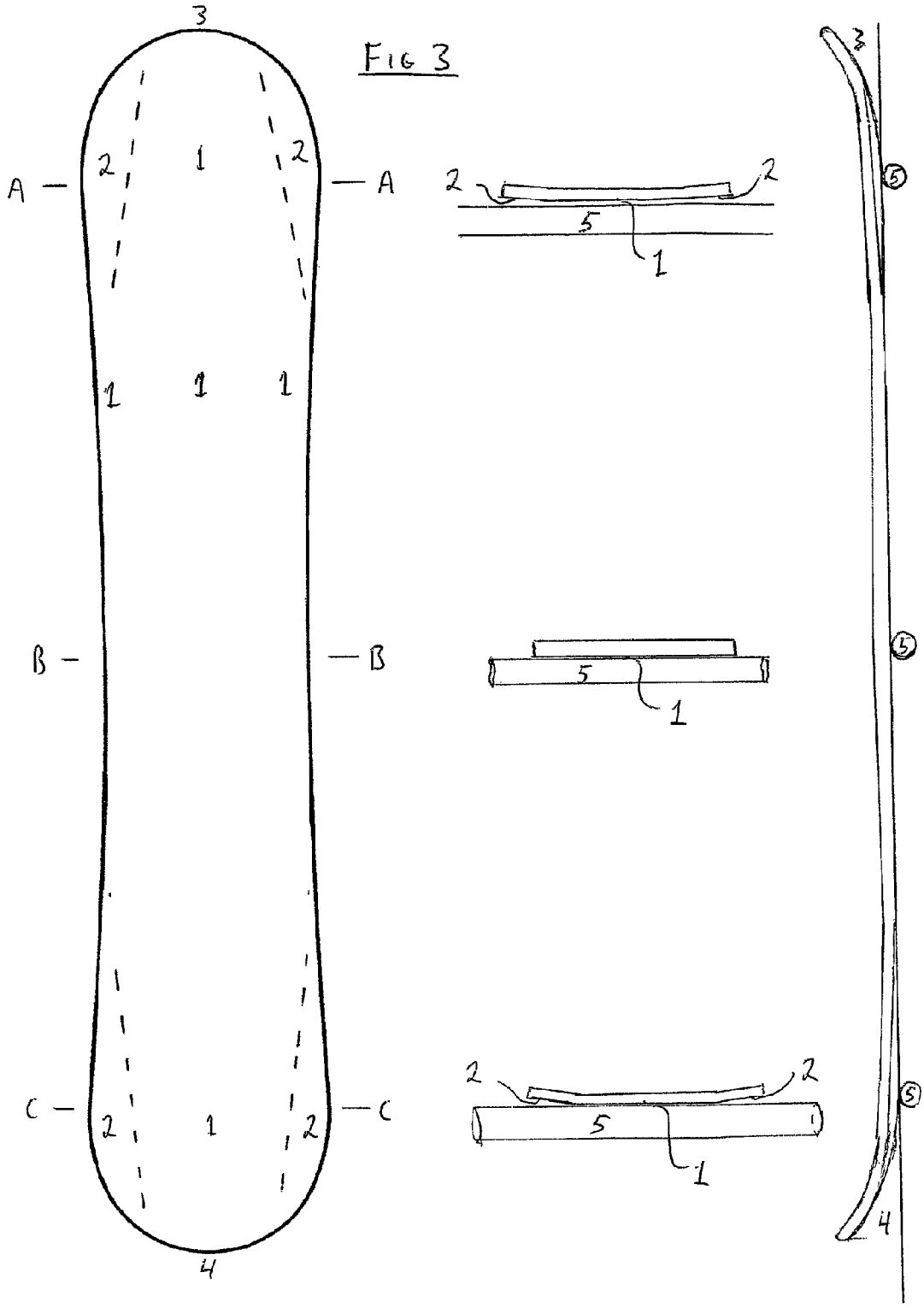
FIG. 3 shows top, side and cross-sectional views of a third embodiment of a snowboard to the disclosure.

FIG. 3 illustrates a snowboard where there are secondary lateral areas 2 only at the front and rear, while the board is flat along its entire width in the central portion, and the secondary base areas have a decreasing width from the tips in towards the middle. The cross sections show the board along the rail.

Figure 4:
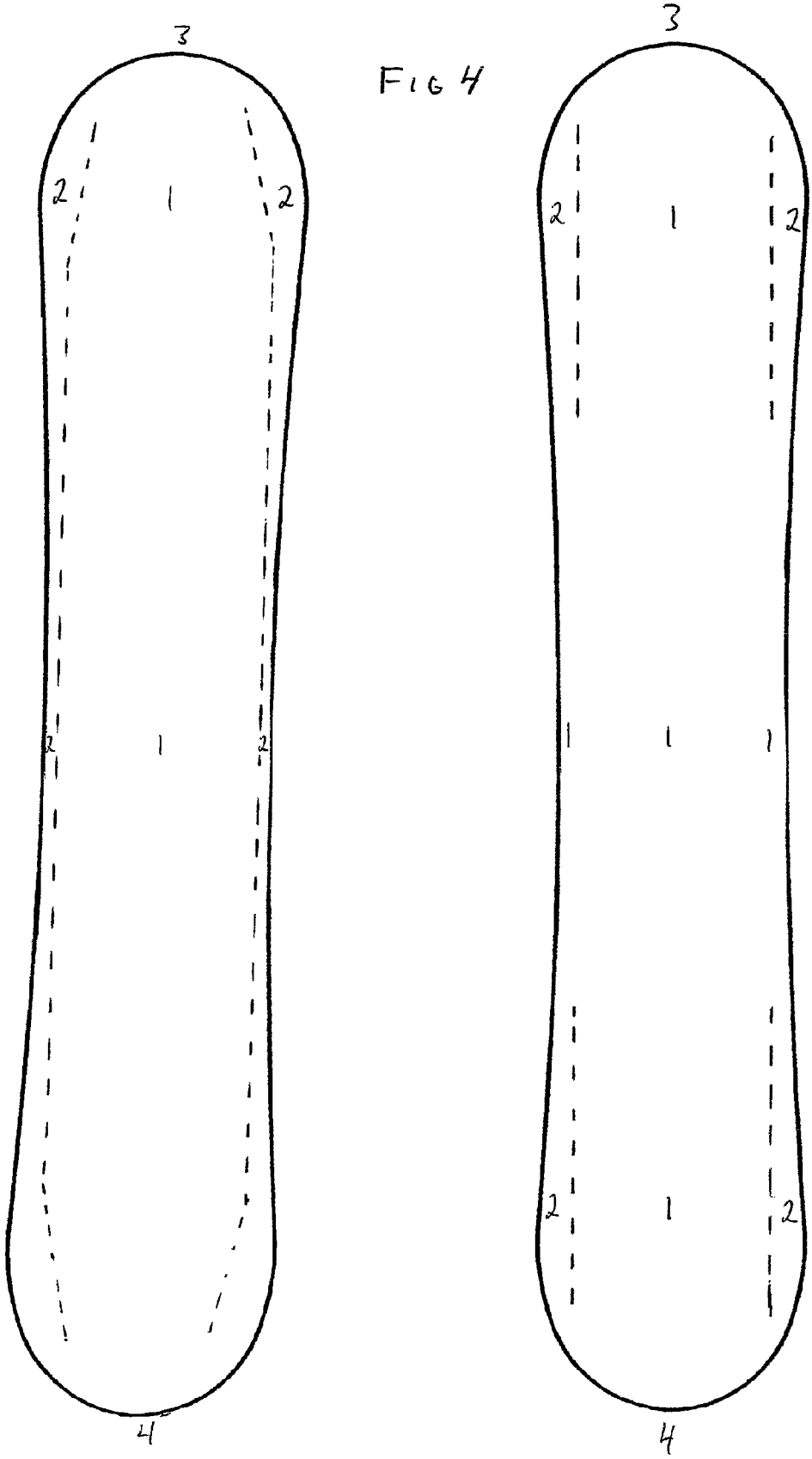
FIG. 4 shows a top view of a fourth and fifth embodiment of a snowboard according to the disclosure.

FIG. 4 illustrates two further possibilities for the location of the secondary lateral areas 2.

DESIGNATIONS IN THE FIGURES

1. First base surface (=central running surface)
2. Secondary lateral areas (=bases outside the first base)
3. Front tip
4. Rear tip
5. Tube (=a type of rail)

It is obvious that most types of known shapes for the top of the board may be combined with this invention. We may mention that it may be of interest to have a flat top on the board round the bindings, thus preventing the shape of the board from being influenced by the bindings being mounted on the board.

Further development according to the invention is based on combining selected features so as to produce a result which is uniquely adapted for a snowboard on rails. By means of the invention a selection of features and dimensions has been made which together provide an improvement.

The invention claimed is:

1. A snowboard for use on rails comprising a board having a length, a base, and a top surface on which two bindings are mounted at a distance apart approximately corresponding to around ⅓ of the board's length, where the board base has a first base surface disposed between a first transversal axis and a second transversal axis, the first base surface being is designed with inwardly curved edge portions, the board having a first end between the first transversal axis and a first upwardly curved tip, the board having a second end between the second transversal axis and a second upwardly curved tip, the board being wider at the first and second ends than the first base surface, wherein:

a) more than 70% of the base is composed of a flat central portion between the first and second transversal axes and
b) the base further includes secondary running surfaces from steel edges and inwards to form an angle with the first base surface, the secondary running surfaces being provided either along the entire length of the board or at any rate along the first and second ends of the snowboard,
c) in an arbitrary cross section, where there are secondary running surfaces, the secondary running surfaces substantially extend 1-4 cm inwards from the steel edges, before the angle of the running surface changes
d) the secondary running surfaces in the cross sections will form substantially straight lines,
e) the secondary running surfaces are rigid and not in contact with the ground if the board is not being edged,
f) the angle which the secondary running surfaces form with the first base surface is at least 1 degree wherein the angle, viewed in cross section, substantially increases from the first and second transversal axes to the first and second upwardly curved tips, and wherein
g) the secondary running surfaces substantially twist up from the plane of the first base surface as the distance from a central transversal axis of the board increases.

2. A snowboard according to claim 1, wherein the secondary running surfaces are continuous and have a width of between 1-4 cm on the outside of the first base surface.

3. A snowboard according to claim 1, wherein the length of the secondary running surfaces on one side is at least ⅕ of the length of the first base surface on the same side.

4. A snowboard according to claim 1, wherein the secondary running surfaces are wider than 4 cm at the first and second ends.

5. A snowboard according to claim 1, wherein the board is symmetrical about a longitudinal axis of the board.

6. A snowboard according to claim 1, wherein the board is asymmetrical about a longitudinal axis of the board.

7. A snowboard according to claim 1, wherein the board is symmetrical about the central transversal axis.

8. A snowboard according to claim 1, wherein the board is asymmetrical about the central transversal axis.

9. A snowboard according to claim 1, wherein the secondary running surfaces substantially extend 2-3 cm inwards before the angle of the running surface changes.

10. A snowboard according to claim 1, wherein the angle which the secondary running surfaces form with the first base is always greater than 2 degrees.

11. A snowboard according to claim 1, wherein the angle which the secondary running surfaces form with the base is always greater than 3 degrees.

12. A snowboard according to claim 1, wherein the first end has a more moderate tip than the second end.

13. A snowboard according to claim 1, wherein the secondary running surfaces are less than 4 cm between the first and second transversal axis.

14. A snowboard according to claim 1, wherein the secondary running surfaces are substantially continuous along the length of the snowboard.

* * * * *